US012495918B2

(12) United States Patent
Alaidi

(10) Patent No.: US 12,495,918 B2
(45) Date of Patent: Dec. 16, 2025

(54) WRAPPABLE SEAT BLANKET

(71) Applicant: Fareeda Hamadeh Alaidi, Hickory Hills, IL (US)

(72) Inventor: Fareeda Hamadeh Alaidi, Hickory Hills, IL (US)

( * ) Notice: Subject to any disclaimer, the term of this patent is extended or adjusted under 35 U.S.C. 154(b) by 222 days.

(21) Appl. No.: 18/225,900

(22) Filed: Jul. 25, 2023

(65) Prior Publication Data

US 2025/0031878 A1 Jan. 30, 2025

(51) Int. Cl.
*A47G 9/02* (2006.01)

(52) U.S. Cl.
CPC ..... *A47G 9/0223* (2013.01)

(58) Field of Classification Search
CPC ..... A47C 31/10; A47C 31/11; A47G 9/0223
USPC ..... 297/225; 108/90; 150/158
See application file for complete search history.

(56) References Cited

U.S. PATENT DOCUMENTS 1,303,020 A * 5/1919 Brock ..... A47C 31/11 297/225
1,817,404 A * 8/1931 Whaley ..... B60N 2/6054 5/496
2,306,987 A * 12/1942 Yount ..... A47C 31/11 206/494
2,469,520 A * 5/1949 Roberts, Jr. ..... A47C 31/11 5/496
2,800,169 A * 7/1957 Armbrecht ..... A47C 31/11 297/225
2,820,510 A * 1/1958 Sugarman ..... A47C 31/11 297/228
2,844,192 A * 7/1958 Marquez ..... B60N 2/60 297/452.58
2,944,664 A * 7/1960 Thomasma ..... A47C 31/11 4/245.9
4,883,701 A * 11/1989 Rankin ..... B32B 7/12 428/137
4,991,242 A * 2/1991 Brown ..... A47G 9/0238 5/601
5,084,321 A * 1/1992 Sui ..... A47G 11/004 428/80
5,441,789 A * 8/1995 Walker ..... A47C 31/11 297/229
6,135,635 A * 10/2000 Miller ..... A47C 31/11 297/229
6,634,709 B1 * 10/2003 Hetherington ..... A47C 31/00 297/229
6,786,256 B2 * 9/2004 Sugawara ..... A47G 11/006 428/192

(Continued)

*Primary Examiner* — Jose V Chen
(74) *Attorney, Agent, or Firm* — Douglas B Teaney; CARDINAL LAW GROUP

(57) ABSTRACT

Embodiments relate to a wrappable blanket for use upon a seat. In some embodiments, the blanket comprises a length, a width, and at least one corner having a concave curvature. The length and width form a blanket portion and first and second wings extending from opposing ends of the blanket portion. Each of the at least one corners forms a cutout in the shape of a quarter-circle. The blanket may further include upper and lower straps with fasteners attached thereto. A method of using the blanket comprises providing the blanket upon a seat structure; wrapping the upper straps over a backrest of the seat structure and the lower straps under a base of the seat structure and engaging free ends of the straps with the fastener ends; positioning a user upon the blanket portion; and folding and securing the wings over the user with hook and loop material.

6 Claims, 7 Drawing Sheets

(56) References Cited

U.S. PATENT DOCUMENTS 7,223,177 B2 * 5/2007 Tarbell ..... A63D 15/00 473/30
7,311,958 B2 * 12/2007 Morris ..... B32B 5/245 428/80
9,788,671 B1 * 10/2017 Wuerz ..... A41D 3/08
10,730,261 B1 * 8/2020 Weir ..... B32B 5/22
2006/0012228 A1 * 1/2006 Bardouche ..... A47C 31/11 297/228.12
2007/0176474 A1 * 8/2007 Miller ..... A47C 31/11 297/229
2008/0060132 A1 * 3/2008 Bradford ..... A47G 9/02 5/482
2010/0139001 A1 * 6/2010 Mangano ..... A47G 9/1045 297/229
2010/0140994 A1 * 6/2010 Moore ..... A47C 31/11 297/229
2010/0314915 A1 * 12/2010 Mills ..... B62B 5/0013 297/219.12
2011/0011762 A1 * 1/2011 Hurst ..... B65D 65/08 206/326
2012/0193958 A1 * 8/2012 DePasquale ..... B60N 2/7005 297/228.11
2014/0049091 A1 * 2/2014 Gross ..... A47C 31/11 297/452.63
2014/0265483 A1 * 9/2014 Miller ..... A47C 31/11 297/228.12
2016/0338502 A1 * 11/2016 Markowitz ..... A47C 31/11
2016/0353904 A1 * 12/2016 Schechtman ..... A47C 12/00
2017/0303698 A1 * 10/2017 Howie ..... A47C 7/021
2017/0367491 A1 * 12/2017 Reaves ..... A47C 31/11
2019/0254441 A1 * 8/2019 Bell ..... A47C 31/11
2020/0329883 A1 * 10/2020 Jaikaransingh ..... A47C 31/10
2023/0166645 A1 * 6/2023 Umlauf ..... B60N 2/6027 297/229

* cited by examiner

WRAPPABLE SEAT BLANKET

FIELD OF THE INVENTION

The invention relates to, blankets, particularly to a wrappable blanket for use with a seat.

BACKGROUND OF THE INVENTION

In cold temperature environments, it is often crucial to retain body heat for reasons related to both health and comfort. Even indoors or within a vehicle, enduring long periods at lower temperatures can lead to sickness, particularly in children and the elderly. Cold weather can also cause stiffness of the joints and back for the elderly and individuals suffering from arthritis or other conditions. While indoor settings and vehicles are typically equipped with a heating system, they may be costly to operate or require a power source and sometimes cannot adequately counteract air leakage. Further, one individual in a given setting may prefer a greater degree of warmth than others, making it impractical to raise the temperature of the entire setting.

While the use of blankets is a very simple and common method of providing warmth and/or comfort in various environments, it is often difficult for a user in a seated position to most effectively utilize a blanket. This difficulty is particularly pronounced when the user is performing a task while seated, such as operating a vehicle, using a computer or other electronic device, reading, writing, or studying. A typical blanket frequently shifts or bunches up in an uncomfortable manner due to the body movements that are natural during the performance of a task, and may even interfere with the task. Further, when the blanket is wrapped around the user, it limits the user's movement and may not retain its position throughout the use. When the user moves or adjust position, the blanket may require gripping with the hands to hold it in place.

The prior art has disclosed various blanket arrangements for keeping a user warm while in a seated position. For example, U.S. Pat. No. 6,764,134 B1 and US 2010/0140993 A1 teach configurations of a travel wrap that can be attached over a seating structure for providing warmth, comfort, and privacy. The travel wrap includes wing members at the sides which may be employed to enclose the seat occupant. However, these travel wraps envelope the seat occupant and would substantially hinder the performance of various tasks. Further, they are designed for use with seats in public transit, and are not easily used with other seating arrangements, such as those lacking a head rest.

US D555,409 S discloses a blanket for use in a vehicle having wrappable wing members. However, the blanket is designed for use with a child car seat rather than an adult driver seat and its shape may impede the driver's motion or interfere with the steering wheel.

For the foregoing reasons, it would be desirable to provide a blanket for use in a seated position for providing warmth and comfort to a user. There is a need for a blanket that is adaptable to different seating arrangements and preserves the user's freedom of motion for performing tasks while using the blanket and does not interfere with objects in the surrounding environment. Further, there is a need for a blanket that is capable of retaining its position and avoids uncomfortable shifting or bunching.

SUMMARY OF THE INVENTION

Embodiments relate to a wrappable seat blanket for use upon a seat. An embodiment of the invention provides a blanket configured to attach to a seat and wrap around a user in order to retain body heat and warm the body of the user.

An embodiment of the invention provides a blanket for attachment to a seat structure, the blanket comprising a length; a width being greater than the length; and at least one corner having a concave curvature and extending radially inward with respect to the blanket.

An embodiment of the invention provides a blanket for attachment to a seat structure, the blanket comprising: a blanket portion having a longitudinal axis, a user contact face, a seat contact face, a first end, and a second end; a first wing extending from the first end in a direction perpendicular to the longitudinal axis, and comprising a proximal end formed continuously with the blanket portion and a free distal end opposite the proximal end, an upper section, and a lower section; a second wing extending from the second end, perpendicular to the longitudinal axis, and comprising a proximal end formed continuously with the blanket portion and a free distal end opposite the proximal end, an upper section, and a lower section; wherein the blanket portion is substantially shaped as a rectangle; wherein the first wing is substantially shaped as a rectangle with at least one cutout in the shape of a quarter-circle at the distal end; and wherein the second wing is substantially shaped as a rectangle.

An embodiment of the invention provides a blanket for attachment to a seat structure, the blanket comprising: a blanket portion substantially shaped as a rectangle comprising a longitudinal axis, a user contact face, a seat contact face, a first end, and a second end; a first wing extending from the first end in a direction perpendicular to the longitudinal axis, and comprising a proximal end formed continuously with the blanket portion and a free distal end opposite the proximal end, an upper section, and a lower section, wherein the first wing is substantially shaped as a rectangle and comprises a first cutout in the shape of a quarter-circle in the upper section of the distal end and a second cutout in the shape of a quarter-circle in the lower section of the distal end; a second wing extending from the second end, perpendicular to the longitudinal axis, and comprising a proximal end formed continuously with the blanket portion and a free distal end opposite the proximal end, an upper section, and a lower section, wherein the second wing is substantially shaped as a rectangle and comprises a third cutout in the shape of a quarter-circle in the upper section of the distal end and a fourth cutout in the shape of a quarter-circle in the lower section of the distal end; wherein the blanket portion, first wing, and second wing are continuously formed by three stacked layers of material comprising: a first layer of material including a first pair of slits extending therethrough at an upper end thereof and a second pair of slits extending therethrough at a lower end thereof; a second layer of material stacked upon the first layer and including a third pair of slits extending therethrough; a third layer of material stacked upon the second layer and including a fourth pair of slits extending therethrough; a pair of upper straps extend through the fourth pair of slits, followed by the third pair of slits, and out of the first pair of slits, and a second pair of straps extend through the fourth pair of slits, followed by the third pair of slits, and out of the second pair of slits; wherein each of the straps of the first and second pairs of straps comprises a buckle on an end thereof for securing the strap around the seat structure and adjustably tightening or loosening the strap to fit the seat structure; wherein the first wing comprises a hook material at its distal end and the second wing comprises a loop material at its distal end configured to mate with the hook material; and wherein a periphery of the blanket comprises rounded edges.

An embodiment of the invention is a method of using a blanket with a seat structure having a base and a backrest, the method comprising: providing a blanket comprising: a blanket portion having a longitudinal axis, a user contact face, a seat contact face, a first end, and a second end; a first wing extending from the first end in a direction perpendicular to the longitudinal axis, and comprising a proximal end formed continuously with the blanket portion and a free distal end opposite the proximal end, an upper section, and a lower section, wherein the first wing is substantially shaped as a rectangle and comprises a first cutout in the shape of a quarter-circle in the upper section of the distal end and a second cutout in the shape of a quarter-circle in the lower section of the distal end; a second wing extending from the second end, perpendicular to the longitudinal axis, and comprising a proximal end formed continuously with the blanket portion and a free distal end opposite the proximal end, an upper section, and a lower section, wherein the second wing is substantially shaped as a rectangle and comprises a third cutout in the shape of a quarter-circle in the upper section of the distal end and a fourth cutout in the shape of a quarter-circle in the lower section of the distal end; wherein the first wing comprises a hook material at its distal end and the second wing comprises a loop material at its distal end configured to mate with the hook material; a pair of upper straps extending through the blanket portion, each upper strap comprising a free end and a fastener end having a buckle thereon, and a second pair of straps extending through the blanket portion, each lower strap comprising a free end and a fastener end having a buckle thereon; placing the seat contact face of the blanket portion upon the seat structure; wrapping the free ends of the upper straps over the backrest of the seat structure and engaging the free ends with the buckles of the fastener ends; passing the free ends of the lower straps under the base of the seat structure and engaging the free ends with the buckles of the fastener ends; positioning a user upon user contact face the blanket portion; and folding the first wing and the second wing over the user and stacking their distal ends so as to mate the hook material with the loop material.

An advantage of embodiments of the invention is that the wrappable seat blanket does not interfere with the user's arms during performance of tasks, including but not limited to reading, writing, studying, and using a computer or other electronic device.

An additional advantage of the invention is that the wrappable seat blanket can comfortably be utilized by a driver of a vehicle without interfering with the driver or the steering wheel of the vehicle.

A further advantage of the invention is that the wrappable seat blanket is secured in position around a user and limits uncomfortable shifting or bunching.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF THE DISCLOSURE

Figure 1:
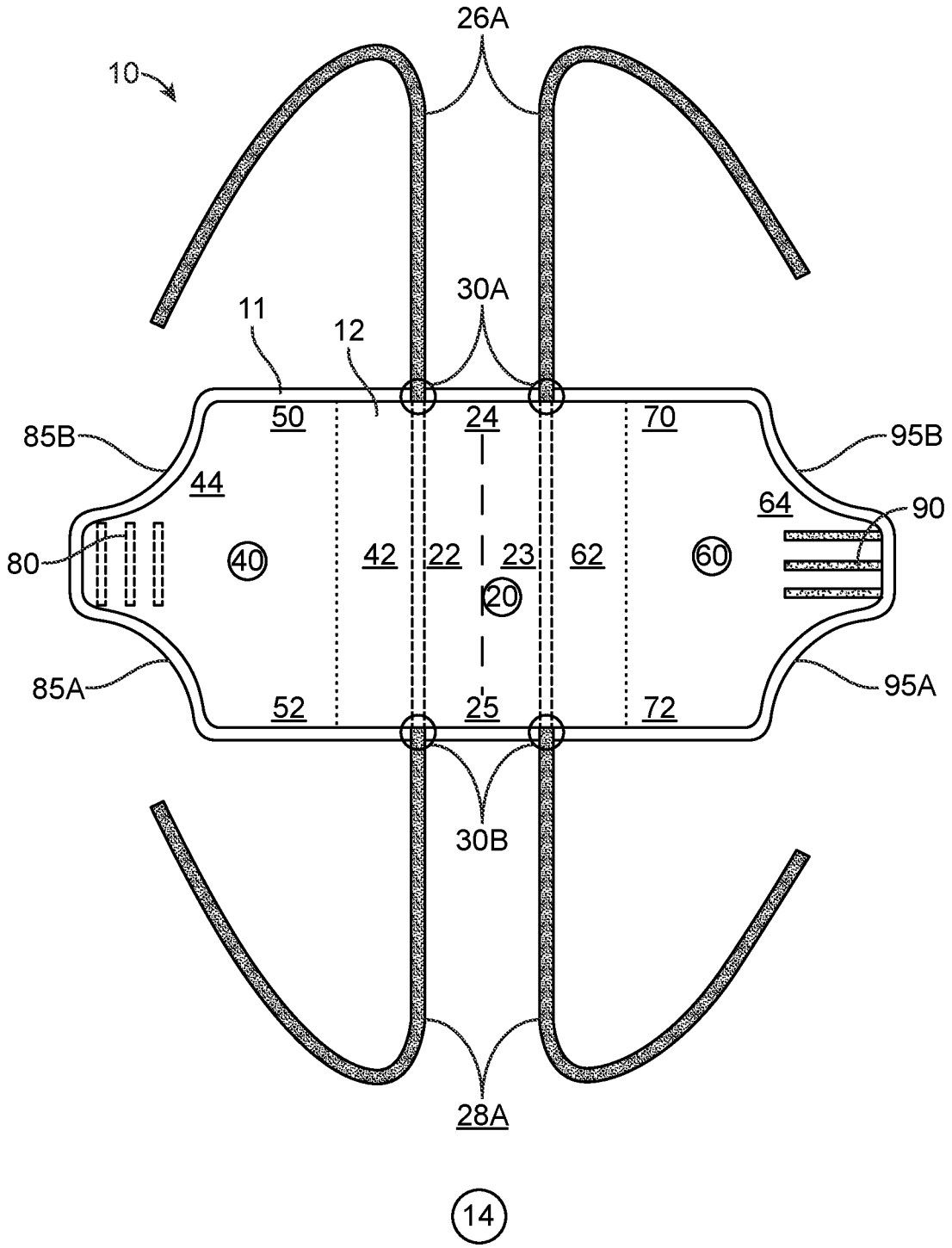
FIG. 1 is a top view of one embodiment of the wrappable seat blanket of the present invention.

While this invention is susceptible of embodiment in many different forms, there are shown in the drawings and described in detail herein, specific embodiments, with the understanding that the present disclosure is to be considered as an exemplification of the principles of the invention and is not intended to limit the invention to the embodiment(s) illustrated.

The invention and accompanying drawings will now be discussed in reference to the numerals provided therein to enable one skilled in the art to practice the present invention. The drawings and descriptions are exemplary of various aspects of the invention and are not intended to narrow the scope of the appended claims. Unless specifically noted, it is intended that the words and phrases in the specification and the claims be given their plain, ordinary, and accustomed meaning to those of ordinary skill in the applicable arts. It is noted that the inventors can be their own lexicographers. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f) or pre-AIA 35 U.S.C. § 112~6. Thus, the use of the words "function," "means" or "step" in the Detailed Description of the Invention or claims is not intended to somehow indicate a desire to invoke the special provisions of 35 U.S.C. § 112(f) or pre-AIA 35 U.S.C. § 112~6 to define the invention. To the contrary, if the provisions of 35 U.S.C. § 112(f) or pre-AIA 35 U.S.C. § 112~6 are sought to be invoked to define the inventions, the claims will specifically and expressly state the exact phrases "means for" or "step for" and the specific function (e.g., "means for roasting"), without also reciting in such phrases any structure, material, or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. § 112(f) or pre-AIA 35 U.S.C. § 112~6. Moreover, even if the provisions of 35 U.S.C. § 112(f) or pre-AIA 35 U.S.C. § 112~6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and apparatus are shown or discussed more generally in order to avoid obscuring the invention. In many cases, a description of the operation is sufficient to enable one to implement the various forms of the invention, particularly when the operation is to be implemented in software.

It should be noted that there are many different and alternative configurations, apparatus, and technologies to which the disclosed inventions may be applied. Thus, the full scope of the inventions is not limited to the examples that are described below.

Various aspects of the present invention may be described in terms of functional block components and various processing steps. Such functional blocks may be realized by any number of hardware or software components configured to perform the specified functions and achieve the various results.

It will be appreciated that numerous changes may be made to the present invention without departing from the scope of the claims, including but not limited to combinations of elements or structures of the various illustrated embodiments. For example, while specific materials and/or methods of manufacture of the apparatuses described herein may be discussed, it is understood that one having ordinary skill in the art may select different materials and/or methods of manufacture, as desired or necessary to meet the requirements of a particular application, without departing from the scope of the present invention.

The invention relates generally to a blanket for use with a seat. More particularly, the invention relates to a blanket with wrappable and coupleable wings for attachment to a seat of a vehicle. The wrappable blanket allows for coupling around a driver or passenger in a secure manner in order to provide warmth without significantly impeding the driver or passenger's freedom of movement upon the seat.

Figure 2:
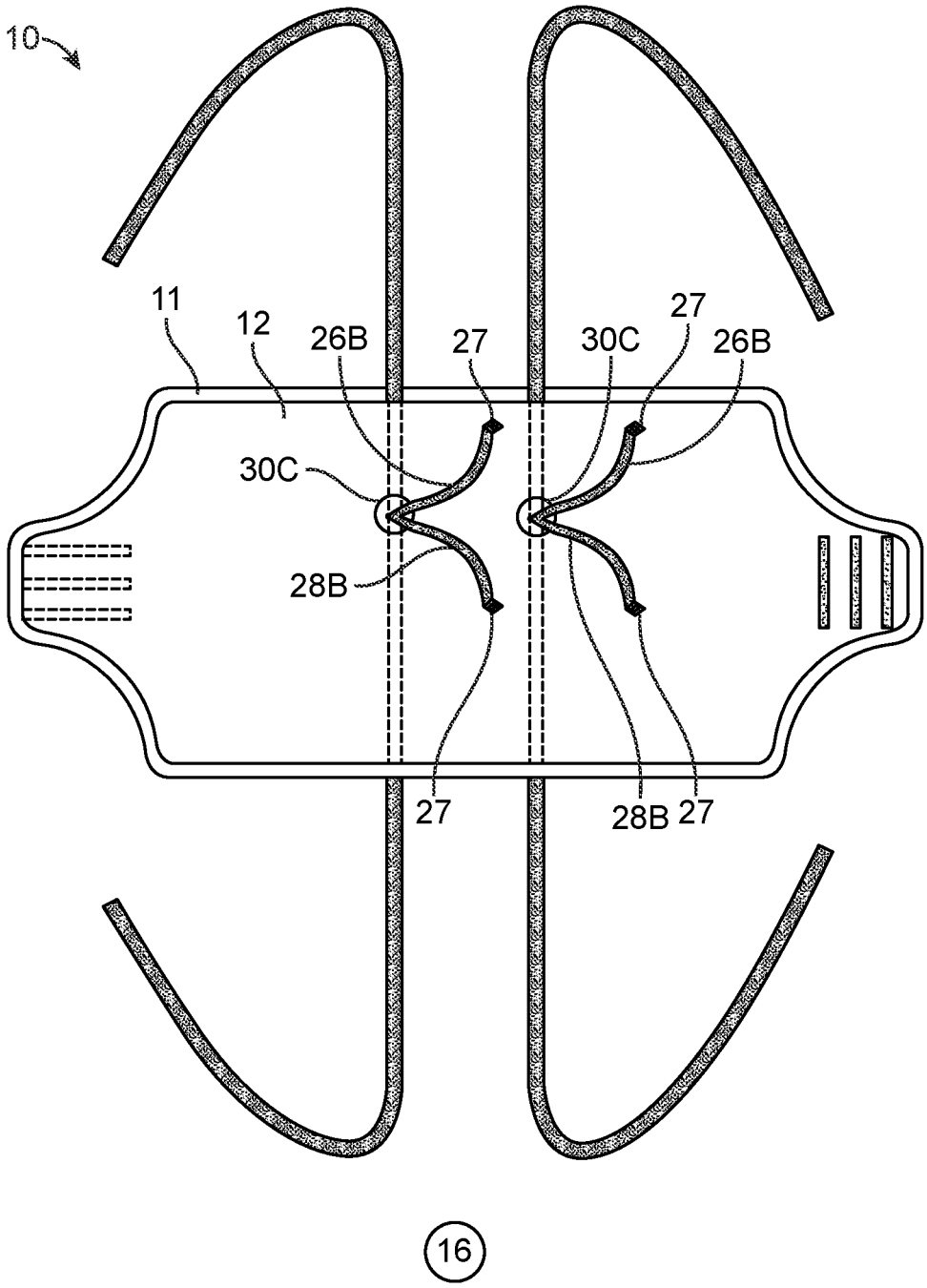
FIG. 2 is a bottom view of one embodiment of the wrappable seat blanket of the present invention.

FIGS. 1 & 2 are a top view and bottom view, respectively, of one embodiment of the wrappable seat blanket of the present invention. The wrappable seat blanket 10 includes a blanket portion 20, a first wing 40, and a second wing 60, together defining a length and a width greater than the length. The blanket 10 includes at least one corner 85A-B, 95A-B (also referred to as a cutout) having a concave curvature with a substantially constant radius of curvature and extending radially inward with respect to the blanket 10. Thus, the at least one corner 85A-B, 95A-B forms a cutout in the shape of a quarter-circle.

In at least one embodiment, the wrappable seat blanket 10 as shown in FIGS. 1-2 comprises a body 12 formed by blanket portion 20, first wing 40, and a second wing 60. The wrappable seat blanket can also be subdivided into a user contact face 14 and a seat contact face 16 opposite the user contact face 14. Each of the blanket portion 20, first wing 40, and second wing 60 form a segment of the user contact face 14 and a segment of the seat contact face 16.

Figure 3A:
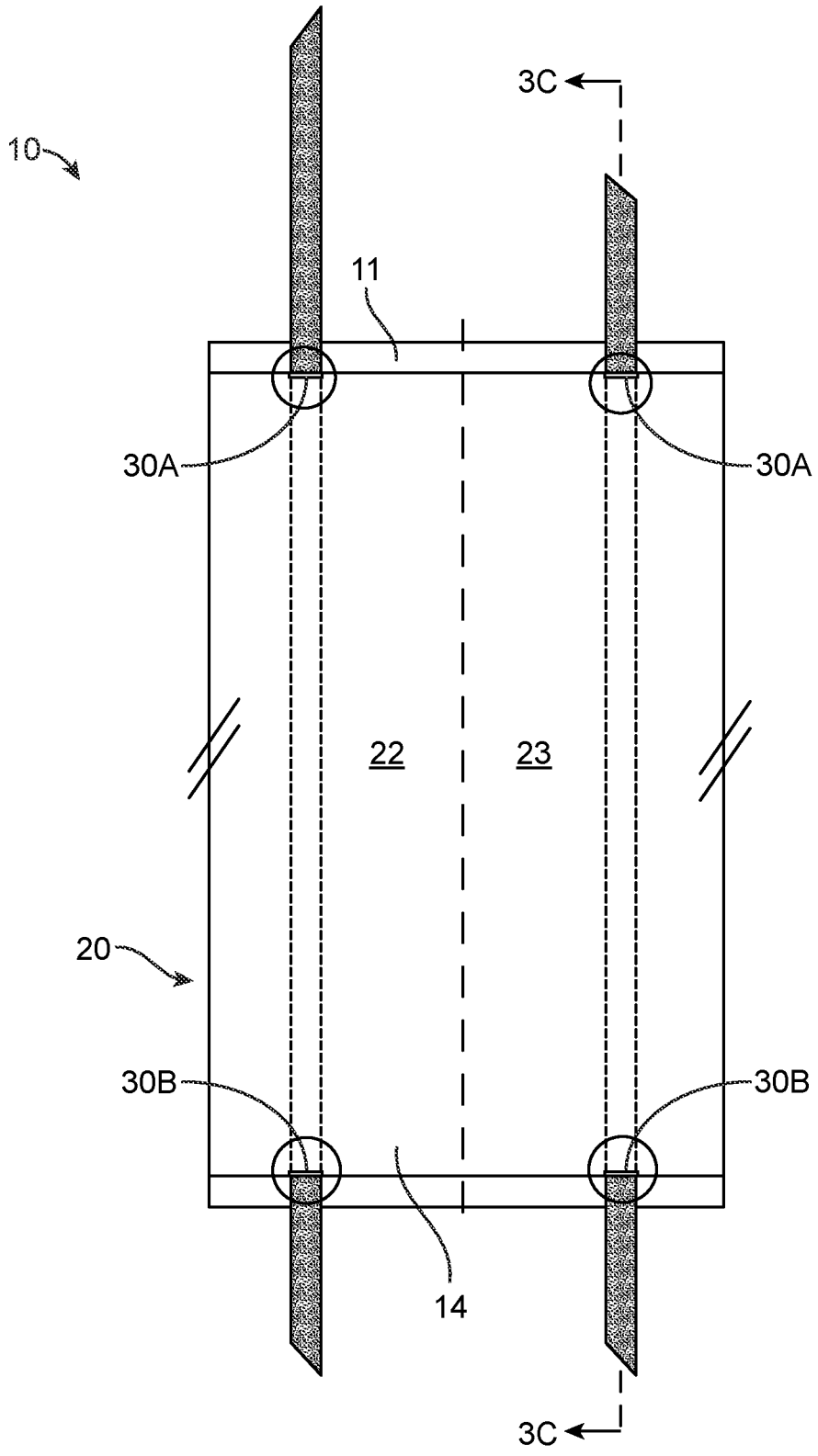
FIG. 3A is a close-up view of a blanket portion of FIG. 1.
Figure 3B:
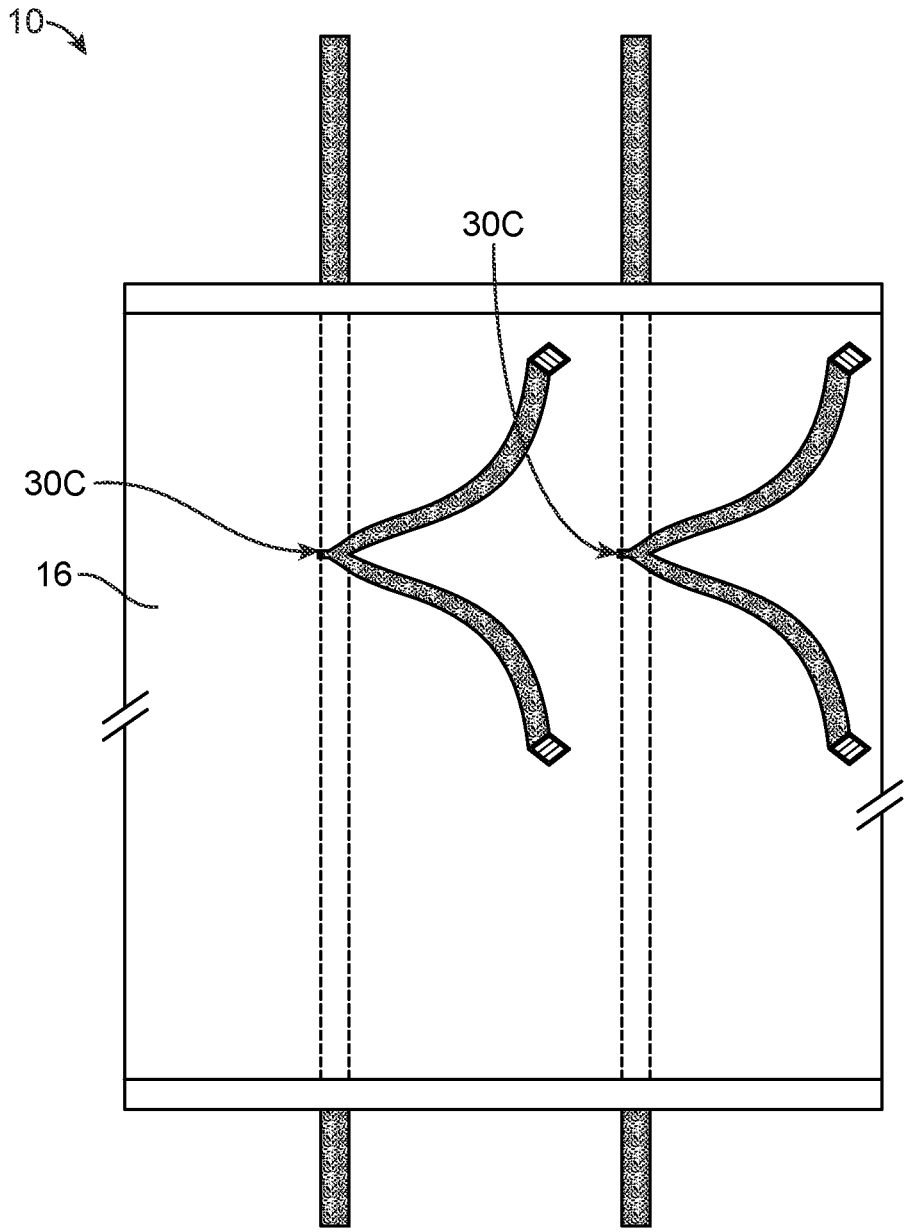
FIG. 3B is a close-up view of a blanket portion of FIG. 2.
Figure 3C:
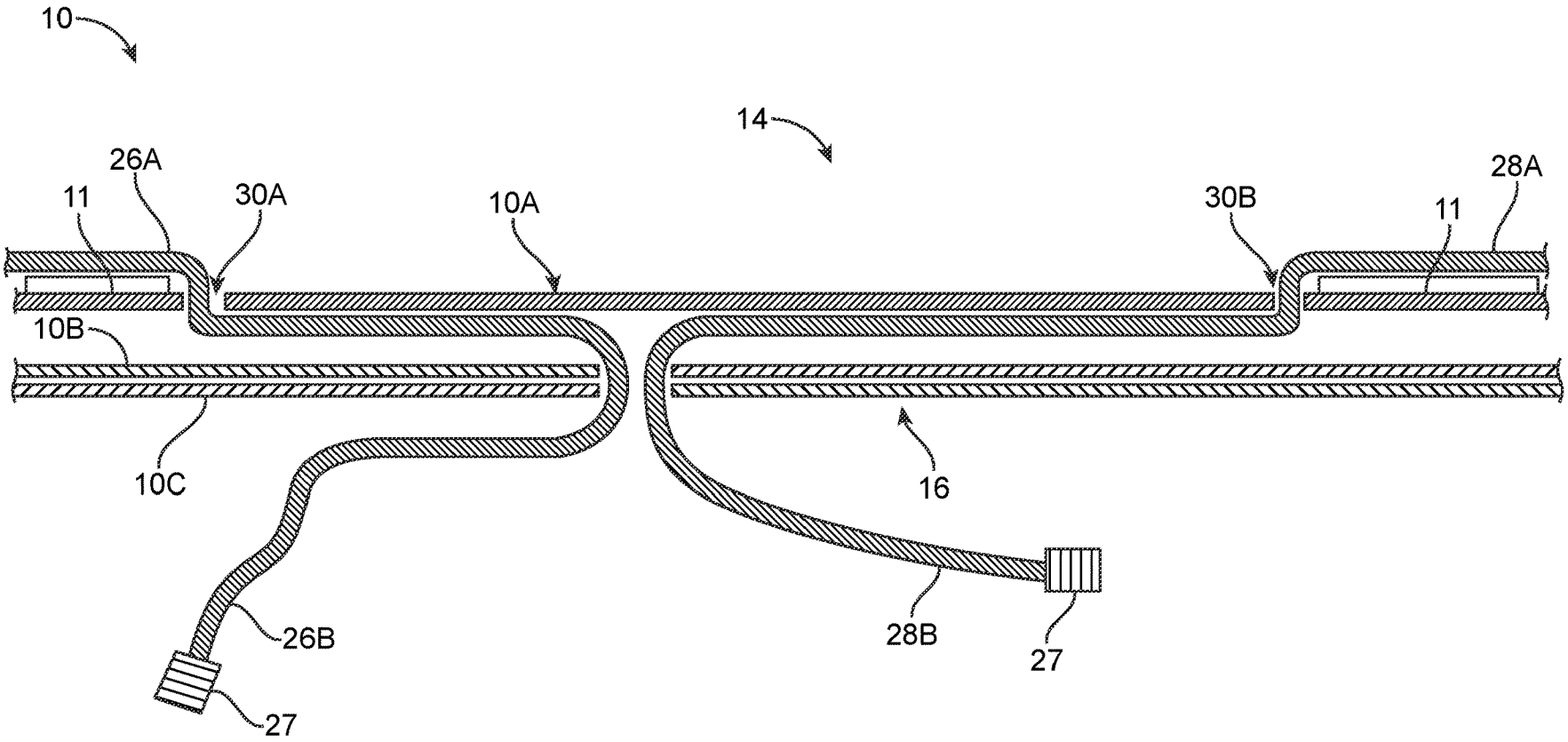
FIG. 3C is a sectional view of the blanket portion of FIG. 3A, taken along line 3C-3C of FIG. 3A.

FIGS. 3A-3C are close-up views detailing a user contact face and a seat contact face, respectively, of the wrappable seat blanket 10. Referring now to FIG. 3A, user contact face 14 of the blanket portion 20 is depicted in further detail. The blanket portion 20 includes a first end 22 and a second end 23 opposite the first end 22. In at least one embodiment, the blanket portion 20 is substantially rectangular in shape. In one embodiment, the blanket portion 20 is 30 inches long and 20 inches wide. The user contact face 14 of the blanket 10 comprises a first pair of slits 30A extending through the first layer 10A at an upper segment 24 of the blanket portion 20. The slits 30A are spaced from one another and are situated near the upper edge of the first layer 10A. In some embodiments, the slits 30A are within 1 inch of the upper edge of the first layer 10A. In some embodiments, the spacing between the slits 30A is 8 inches. In embodiments having a liner 11 along the periphery of the blanket 10, the slits 30A can be situated immediately adjacent the liner 11, at the uppermost exposed point on the first layer 10A.

Additionally, the user contact face 14 of the blanket 10 comprises a second pair of slits 30B extending through the first layer 10A at a lower segment 25 of the blanket portion 20. The slits 30B are spaced from one another and are situated near the lower edge of the first layer 10A. In some embodiments, the spacing between the slits 30B is identical to the spacing between the slits 30A. In some embodiments, the slits 30B are within 1 inch of the lower edge of the first layer 10A. In embodiments having a liner 11 along the periphery of the blanket 10, the slits 30B can be situated immediately adjacent the liner 11, at the lowermost exposed point on the first layer 10A.

Referring now to FIG. 3B, the seat contact face 16 of the blanket portion 20 is depicted in further detail. The seat contact face 16 of the blanket 10 comprises a third pair of slits 30C extending through both the second and third layers 10B-10C of the blanket 10. In other words, each slit 30C is cut through the second and third layers 10B-10C, thus forming a passage extending through the second and third layers 10B-10C. The slits 30C are spaced from one another and are situated at a point along the length of the blanket portion 20 that is between the first pair of slits 30A and the second pair of slits 30B. In one embodiment, the slits 30C are 10 inches from the upper edge of the blanket portion 20. In some embodiments, the spacing between the slits 30C is identical to the spacing between the slits 30A or the spacing between the slits 30B.

Referring once again to FIGS. 1-2, a first wing 40 is secured to the first end 22 of the blanket portion 20. The first wing 40 comprises a medial end 42 joined to the first end 22 of the blanket portion 20, and a distal end 44, which is a free end opposite the medial end 42. The first wing 40 can also be subdivided into an upper section 50 and a lower section 52 opposite the upper section 50. In one embodiment, the first wing 40 is 30 inches long and 25 inches wide. The first wing 40 includes a fastener material 80 on the seat contact face 16 at its distal end 44. In some embodiments, the fastener material 80 is a hook material for hook-and loop fasteners. However, other fasteners such as loop material, snaps, clasps, buttons, buttonholes, or any other fasteners known in the art are contemplated.

A second wing 60 is secured to the second end 23 of the blanket portion 20. The second wing 60 comprises a medial end 62 joined to the second end 23 of the blanket portion 20, and a distal end 64, which is a free end opposite the medial end 62. The second wing 60 can also be subdivided into an upper section 70 and a lower section 72 opposite the upper section 70. In one embodiment, the second wing 60 is 30 inches long and 25 inches wide. The second wing 60 includes a fastener material 90 on the user contact face 14 at its distal end 64. The fastener material 90 is complementary to the fastener material 80. In some embodiments, the fastener material 90 is a loop material for hook-and-loop fasteners. However, other fasteners such as hook material, snaps, clasps, buttons, buttonholes, or any other fasteners known in the art are contemplated. Alternatively, the fastener material 80 may be disposed on the seat contact face 16 and the fastener material 90 may be disposed on the user contact face 14.

Referring still to FIGS. 1-2, the wings 40, 60 may include a corner cutout formed therein. While the wings 40, 60 have a substantially rectangular shape, their size and shape may be adjusted by removing a portion from its rectangular shape, resulting in a cutout. At least one of the wings 40, 60 comprises one or more cutouts 85A-B, 95A-B at its distal end. While the cutouts 85A-B, 95A-B may be formed in any shape, in one embodiment depicted in FIGS. 1-2, they advantageously form a concave curvature with a substantially constant radius of curvature, resulting in the shape of a quarter-circle, i.e. a mathematical quadrant, having a radius of approximately 10 inches. In an embodiment, the second wing 60 comprises a cutout 95A formed at the lower section 72 of the distal end 64. The first wing 40 may also comprise a cutout 85A at the lower section 52 of the distal end 44. The first and second wings 40, 60 may additionally include similar cutouts 85B, 95B at the upper sections 50, 70 of their distal ends 44, 64, respectively. In some embodiments, the corners formed by the cutouts 85A-B, 95A-B are rounded.

The cutouts 85A-B, 95A-B also result in the most distal extent of the wings 40, 60 forming a flap, i.e., a strip of material having a reduced length with respect to the remainder of the wings 40, 60. The flaps are adjacent the cutouts 85A-B, 95A-B and in the embodiment comprising both cutouts 85A, 95A and 85B, 95B, the flap is formed between the two cutouts of each wing 40, 60. The flaps are also the section upon which the fastener material 80, 90 is situated.

The cutouts provide several distinct advantages to the blanket 10. By providing the cutouts 85A-B, 95A-B, the first and second wings 40, 60 afford the same coverage of the body of the user while reducing the likelihood of the wings 40, 60 inadvertently folding, crumpling, or bunching up in the lap of the user. The blanket 10 thus occupies less space and does not create any additional discomfort or restriction of the user's range of motion due to the positioning and bunching of the blanket. Moreover, the reduced space occupied by the blanket prevents any discomfort to adjacently seated individuals without reducing the warmth provided to the user. Further, the cutouts 85A, 95A are additionally advantageous because they prevent the blanket 10 from interfering with the steering wheel W of the automobile. Similarly, the cutouts 85B, 95B prevent the blanket 10 from interfering with the arms of the user and restricting range of motion while driving or performing any other tasks. As a result of the cutouts 85A-B, 95A-B, less material is required in the production of the blanket 10, thus reducing the cost of manufacture.

The wrappable seat blanket 10 is formed of an insulating material such as fleece. However, the blanket 10 can be formed from any natural or synthetic textiles such as felt, wool, cotton, polyester, or any other material commonly used to construct blankets as is known in the art. The blanket 10 is formed of one or more layers of the material to provide greater thickness and warmth to the user. In one embodiment, the blanket 10 shown in FIGS. 1-2 comprises three layers of the material: a first layer 10A, forming the entirety of the user contact face 14; a second layer 10B (not shown), between the user contact face 14 and the seat contact face 16; and a third layer 10C, forming the entirety of the seat contact face 16. The layers 10A10C are joined together by stitching along the entire periphery to form a seam. Optionally, a thin trim or liner 11 can be sewn around the entire periphery. The liner 11 serves as a decorative component as well as a covering for the exposed ends of the layers 10A-10C, thus providing a clean finish. In one embodiment, the liner 11 is formed of cotton, however it is contemplated that it may be formed from any of the materials used in constructing the layers 10A-10C of the blanket 10.

As depicted in FIGS. 3A-3C a pair of upper straps 26 are passed through the pairs of slits 30A and 30C. Each upper strap 26 comprises a free end 26A and an opposing fastener end 26B having a fastener 27 attached thereto. In one embodiment, each fastener 27 is a buckle, as depicted in FIG. 3B. The free end 26A of a first upper strap 26 is passed through a first slit of the pair of slits 30C, and passed along the length of the blanket portion 20 between the first layer 10A and second layer 10B until it is pulled through a first slit of the pair of slits 30A, where it exits the blanket 10. The fastener end 26B of the first upper strap 26 remains protruding out of the slit 30C. A second upper strap 26 is similarly situated through the corresponding second slits of the pairs of slits 30A and 30C.

With continuing reference to FIGS. 3A-3C, a pair of lower straps 28 are passed through the pairs of slits 30B and 30C. Each lower strap 28 comprises a free end 28A and an opposing fastener end 28B having a fastener 27 attached thereto, similar to the fasteners of the upper straps 26. The free end 28A of a first lower strap 28 is passed through the first slit of the pair of slits 30C, and passed along the length of the blanket portion 20 between the first layer 10A and second layer 10B until it is pulled through a first slit of the pair of slits 30B, where it exits the blanket 10. The fastener end 28B of the first lower strap 28 remains protruding out of the slit 30C. A second lower strap 28 is similarly situated through the corresponding second slits of the pairs of slits 30B-30C.

In one embodiment, each of the straps 26, 28 are approximately 60 inches in length and 1 inch in width. The corresponding slits 30A-30C are also approximately 1.125 inches in width, in order to securely fit the straps 26, 28 therethrough. However, it is contemplated that the dimensions of the straps can be adjusted as desired for securing the blanket 10 to seats of varying sized and dimensions. Likewise, the dimensions of the corresponding slits 30-30C can be adjusted accordingly. The straps 26, 28 may be positioned with the fastener ends 26B, 28B extending approximately 10 inches out of the slits 30C. Further, the straps 26, 28 may be sewn to the blanket portion 20 at or near the slits 30C in order to prevent the straps 26, 28 from sliding out of position. The straps 26, 28 may be additionally sewn to the blanket portion 20 at or near the slits 30A and 30B, respectively.

While FIG. 3B depicts the fastener 27 as a buckle, it is contemplated that the fastener 27 may comprise snaps, clasps, buttons, hook and loop fasteners, or any other fasteners as are known in the art. As is necessary for some types of fasteners, a first portion of the fastener 27 may be located on the fastener end 26B (e.g., a button, a buttonhole, hook material, loop material, etc.) with a corresponding second portion of the fastener located on the free end 26A.

Figure 4A:
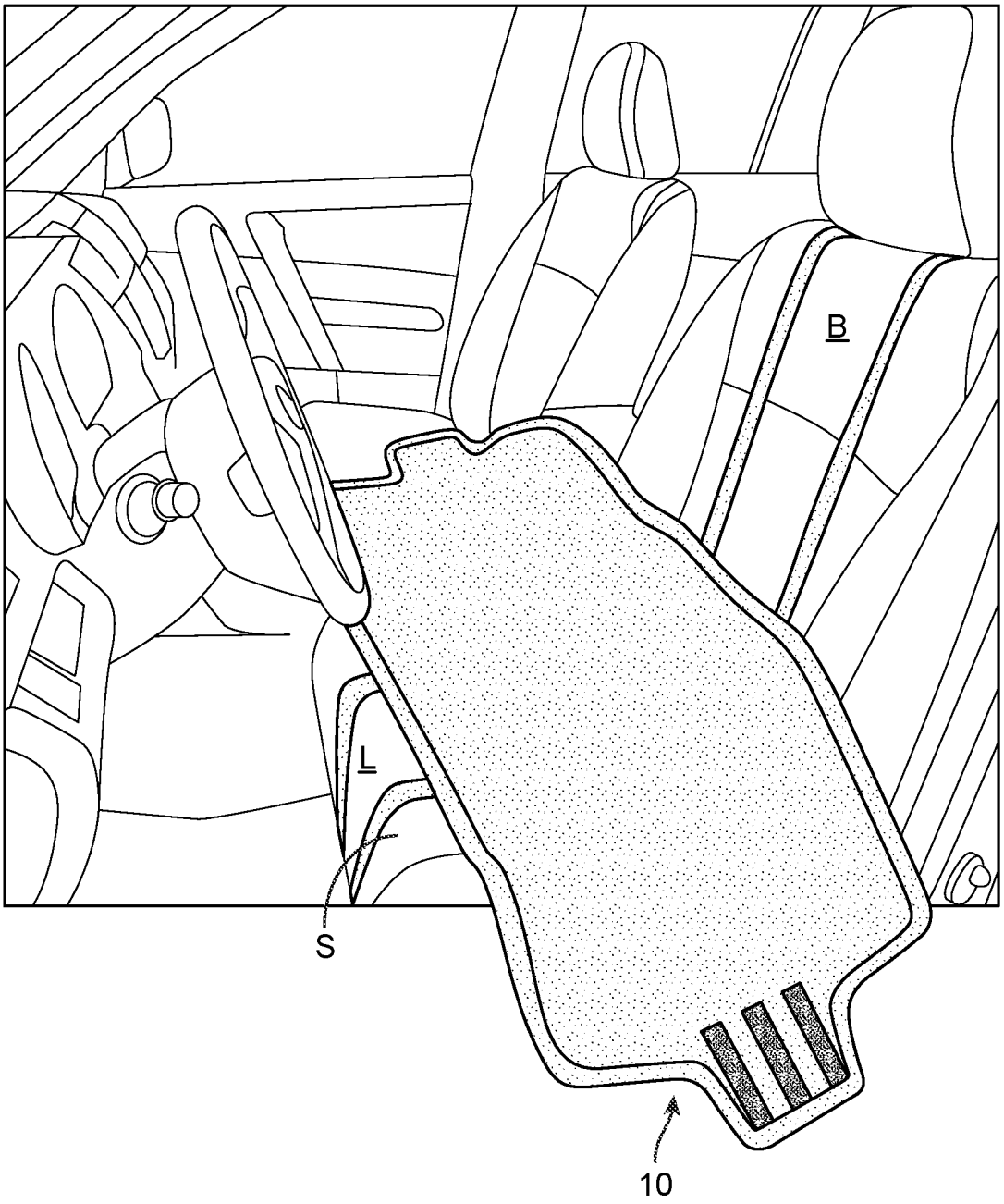
FIG. 4A is a perspective view of the wrappable seat blanket of FIG. 1 secured upon a seat of an automobile in an open configuration.
Figure 4B:
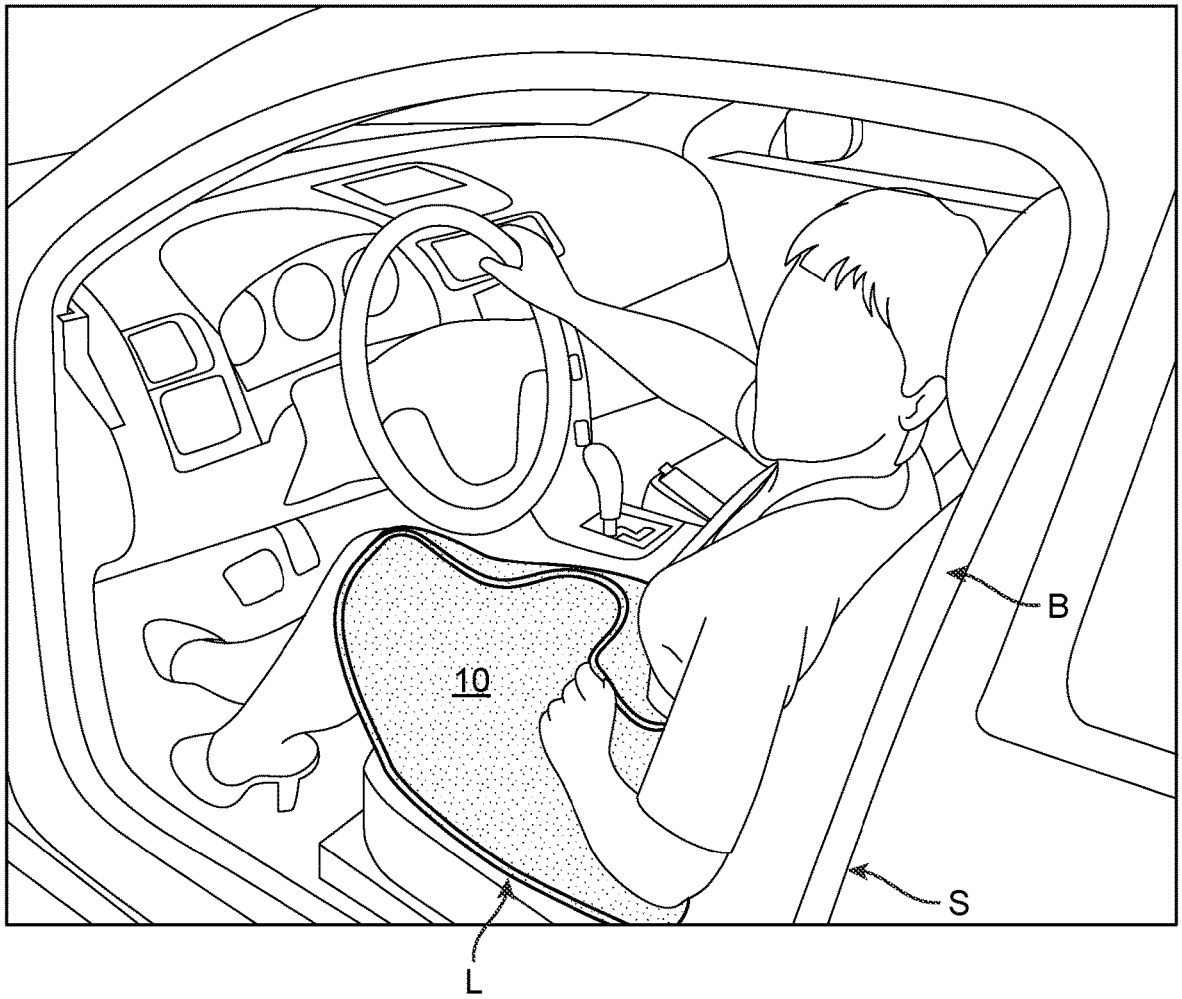
FIG. 4B is a perspective view of the wrappable seat blanket of FIG. 1 secured upon a seat of an automobile in a closed configuration around the body of a user.

In use, a method of using the blanket 10 of the embodiments disclosed herein comprises placing the seat contact face 16 of the blanket portion 20 in contact with a seat S (FIG. 4A-4B). In one embodiment, the seat S is the driver's seat of an automobile, however use of the blanket 10 with other types of seats is contemplated.

FIG. 4A is a perspective view of the wrappable seat blanket of FIG. 1 secured upon a seat of an automobile in an open configuration. Referring to FIG. 4A, the seat S comprises a backrest B that is substantially vertical or upright, and a lower base support L that is substantially horizontal. In one embodiment, the blanket 10 is positioned such that the upper segment 24 is in contact with the backrest B and the lower segment 25 is in contact with the lower base support L. Alternatively, the blanket 10 can be positioned such that the blanket portion 20 contacts only one of the portions B, L of the seat S. Next, the fastener ends 26B, 28B of the straps 26, 28 are passed between the backrest B and the lower base support L. The free ends 26A of the upper straps 26 are then wrapped over the backrest B and engaged with the fasteners 27 of the fastener ends 26B behind the backrest B. Similarly, the free ends 28A of the lower straps 28 are passed under the lower base support L and engaged with the fasteners 27 of the fastener ends 28B behind the lower base support L.

FIG. 4B is a perspective view of the wrappable seat blanket of FIG. 1 secured upon a seat of an automobile in a closed configuration around the body of a user. A user is positioned upon the blanket 10 by sitting upon the blanket portion 20 when the blanket 10 is in an open configuration seen in FIG. 4A, with the wings 40, 60 at the sides, respectively, As seen in FIG. 4B, the blanket is moved into a closed configuration by folding the wings 40, 60 over the lap of the user with at least part of the distal ends of the wings 40, 60 stacked by overlapping each other such that the fastener materials 80, 90 of the wings 40, 60 face one another. The fastener material 80 is mated with the fastener material 90 to secure the blanket 10 in the closed configuration. The blanket 10 envelops a lower section of the user's body, particularly the upper legs and the lower torso (Including part of the user's core and lower back), and utilizes radiated body heat to warm this section of the user's body. Using the blanket 10 In this manner may reduce or alleviate the need for a heater to keep warm. It may further reduce or alleviate stiffness and pain associated with cold weather in this section of the user's body, particularly the joints and back. As can be seen, the cutout(s) on blanket 10 facilitate the accommodation or "integration" of the blanket to the steering wheel, allowing the free-and-easy use of the steering wheel without friction or other interference from the blanket.

While the blanket of the present invention may include four cutouts, the blanket can also be designed with only one, two, or three of the depicted cutouts. In an alternative embodiment, the blanket 10 can be formed with only cutouts 95A, 95B upon the second wing 60 because as depicted in FIG. 4B, the second wing 60 is the uppermost wing in the closed configuration and thus stands the greatest chance of interfering with the user's arms or the steering wheel. The blanket 10 can also be formed with only cutouts 85A, 85B upon the first wing 40, especially in the case wherein the blanket 10 is configured with the first wing as the uppermost wing in the closed configuration. Alternatively, the blanket 10 can be formed with only the upper cutouts 85A, 95A, only the lower cutouts 85B, 95B, or any other combination of two cutouts. In further alternative embodiments, the blanket 10 can be formed with any one cutout or any combination of three cutouts.

While approximate measurements are provided for various components of the blanket of the present invention, it is understood that these dimensions may be modified or adjusted as desired for any purpose, including but not limited to optimizing use with different seats or different sized users. While the blanket of the present invention is designed for use by an adult user of average size, in an alternative embodiment, the blanket may be provided in various sizes with modified dimensions to fit individuals of different sizes, such as larger or smaller adults. In further alternative embodiments, the blanket may be provided in sizes with modified dimensions to fit children or infants. The described modifications may comprise increasing or decreasing the measurements and spacing across the entire blanket in a proportionate manner. Alternatively, individual dimensions, measurements and/or spacing may be adjusted as needed or desired.

While the blanket of the present invention may be designed for use upon the seat of an automobile, use upon other types of seats is contemplated. In an alternative embodiment, the blanket may be used upon a desk or library chair. The dimensions of the blanket may be modified as described above to fit a desk or library chair, and the number and location of cutouts may be adjusted for this purpose. For example, the blanket may utilize shorter straps and/or provide cutouts only at the upper sections of the wings. In further alternative embodiments, the blanket me be used upon a kitchen chair, an armchair, a couch, a stool, a seat of an airplane, a seat of a train, a seat of an automobile other than the driver's seat, an infant car seat, or any other type of seat having a backrest and lower base support. Further, the blanket may be utilized during any stationary activity, including, but not limited to studying, reading, sewing, or using a computer. The blanket is particularly useful, with or without a seat, for settings or activities wherein cold conditions are commonplace, including but not limited to fishing, camping, skiing, and viewing outdoor or indoor sports. Using the blanket in these settings allows both adults and children to keep warm, and thus prevent sickness. The blanket is also useful in warming the lower portions of the body, including but not limited to the knees, hips and lower back, thus reducing stiffness particularly in the elderly. Further it may reduce or alleviate the need for using an electric heating device or the heater of a vehicle, thus being economically effective and not constrained by attachment to a power source.

While the blanket of the present invention is depicted with slits 30A, 30B extending through the first layer 10A and slits 30C extending through the second and third layers 10B-10C, it is contemplated that other slit configurations may be utilized. In an alternative embodiment, the slits 30C extend only through the third layer 10C, while the slits 30A, 30B extend through the first and second layers 10A-10B, thus forming a passage therethrough. In a further alternative embodiment, the slits 30A, 30B may be formed on the seat contact face 16 and the slits 30C may be formed on the user contact face 14. Alternatively, the slits 30A-30C may be formed in any other configuration as needed or desired so long as a continuous passage is formed through the blanket 10 between the slits 30A, 30C as well as between the slits 30B-30C.

While the blanket of the present invention may be formed with three layers of material 10A-10C, it is contemplated that any other number of layers may be utilized. In an alternative embodiment, the blanket may be formed with only two layers 10A, 10C and without a middle layer 10B. In this case, the slits 30C only extend through the third layer 10C. In further alternative embodiments, the blanket may be formed as only a single layer having all of the slits 30A-30C therein. In still further embodiments, the blanket may be formed with four or more layers. In this case, the slits 30A, 30B or the slits 30C must extend through the additional layers such that the straps can pass through the entire blanket as described above with reference to FIGS. 3A-3C.

The materials of the blanket may be decorative. The layers 10A-10C may be provided in a variety of colors and/or patterns as desired to attract different users. In some embodiments, the liner 11 is provided in a color and/or pattern similar to that of the layers 10A10C. In other embodiments, the liner 11 is provided in a contrasting or accent color and/or pattern. In some embodiments, the straps 26, 28 are provided in a color and/or pattern similar to that of the layers 10A-10C and/or the liner 11. In other embodiments, the straps 26, 28 are provided in a contrasting or accent color and/or pattern.

The wrappable seat blanket of the present invention can assume a wide variety of embodiments. Certain exemplary embodiments of the wrappable seat blanket are described herein and shown in the accompanying figures. All presented embodiments are only intended as illustrative and non-limiting examples of the present invention.

While the embodiment(s) of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed is:

1. A blanket for attachment to a seat structure, the blanket comprising:

a length;

a width being greater than the length; and at least one corner having a concave curvature and extending radially inward with respect to the blanket;

wherein the length and width form a blanket portion having a longitudinal axis, a user contact face, a seat contact face opposite the user contact face, a first end, and a second end opposite the first end;

a first wing extending from the first end perpendicular to the longitudinal axis, and having a proximal end formed continuously with the blanket portion and a free distal end opposite the proximal end, an upper section, and a lower section; and a second wing extending from the second end perpendicular to the longitudinal axis, and having a proximal end formed continuously with the blanket portion and a free distal end opposite the proximal end, an upper section, and a lower section;

wherein the blanket portion is substantially rectangular; and wherein the at least one corner having a concave curvature forms an arc at the distal end of the first wing having a constant radius of curvature;

wherein the at least one corner comprises a first corner in the upper section of the first wing and a second corner in the lower section of the first wing;

wherein the second wing further comprises a third corner in the upper section of the distal end of the second wing and a fourth corner in the lower section of the distal end of the second wing; and wherein the first wing includes a first securing flap disposed immediately between the first corner and the second corner, the first securing flap comprising a first fastener element; and the second wing includes a second securing flap disposed immediately between the third corner and the fourth corner, the second securing flap comprising a second fastener element.

2. The blanket of claim 1, wherein each corner forms a cutout in the shape of a quarter-circle.

3. A blanket for attachment to a et t structure, the blanket comprising:

a length;

a width being greater than the length; and at least one corner having a concave curvature and extending radially inward with respect to the blanket;

wherein the length and width form;

a blanket portion having a longitudinal axis, a user contact face, a seat contact face opposite the user contact face, a first end, and a second end opposite the first end;

a first wing extending from the first end perpendicular to the longitudinal axis, and having a proximal end formed continuously with the blanket portion and a free distal end opposite the proximal end, an upper section, and a lower section; and a second wing extending from the second end perpendicular to the longitudinal axis, and having a proximal end formed continuously with the blanket portion and a free distal end opposite the proximal end, an upper section, and a lower section;

wherein the blanket portion is substantially rectangular; and wherein the at least one corner having a concave curvature forms an arc at the distal end of the first wing having a constant radius of curvature wherein the blanket portion further comprises:

a first layer of material forming the user contact face;

a second layer of material between the user contact face and the seat contact face; and a third layer of material forming the seat contact face, wherein the first layer of material includes a first pair of slits at an upper end thereof and a second pair of slits at a lower end thereof, wherein the second layer of material includes a third pair of slits, and Wherein the third layer of material includes a fourth pair of slits.

4. The blanket of claim 3, wherein:

a pair of upper straps extend through the fourth pair of slits, followed by the third pair of slits, and out of the first pair of slits, and a second pair of straps extend through the fourth pair of slits, followed by the third pair of slits, and out of the second pair of slits.

5. A blanket for attachment to a seat structure, the blanket comprising:

a substantially rectangular blanket portion comprising a longitudinal axis, a user contact face, a seat contact face opposite the user contact face, a first end, and a second end opposite the first end;

a first wing extending from the first end perpendicular to the longitudinal axis, and having a proximal end formed continuously with the blanket portion and a free distal end opposite the proximal end, an upper section, and a lower section, wherein the first wing is substantially rectangular and comprises a first cutout in the shape of a quarter-circle in the upper section of the distal end and a second cutout in the shape of a quarter-circle in the lower section of the distal end;

a second wing extending from the second end perpendicular to the longitudinal axis, and having a proximal end formed continuously with the blanket portion and a free distal end opposite the proximal end, an upper section, and a lower section, wherein the second wing is substantially rectangular and comprises a third cutout in the shape of a quarter-circle in the upper section of the distal end and a fourth cutout in the shape of a quarter-circle in the lower section of the distal end;

wherein the blanket portion, first wing, and second wing are continuously formed by three stacked layers of material comprising:

a first layer of material including a first pair of slits extending therethrough at an upper end thereof and a second pair of slits extending therethrough at a lower end thereof;

a second layer of material stacked upon the first layer and including a third pair of slits extending therethrough;

a third layer of material stacked upon the second layer and including a fourth pair of slits extending therethrough; a pair of upper straps extend through the fourth pair of slits, followed by the third pair of slits, and out of the first pair of slits, and a second pair of straps extend through the fourth pair of slits, followed by the third pair of slits, and out of the second pair of slits;

wherein each of the straps of the first and second pairs of straps comprises a buckle on an end thereof for securing the strap around the seat structure and adjustably tightening or loosening the strap to fit the seat structure;

wherein the first wing comprises a hook material at its distal end and the second wing comprises a loop material at its distal end configured to mate with the hook material; and wherein a periphery of the blanket comprises rounded edges.

6. A method of using a blanket with a seat structure having a base and a backrest, the method comprising:

providing a blanket comprising:

a blanket portion having a longitudinal axis, a user contact face, a seat contact face opposite the user contact face, a first end, and a second end opposite the first end;

a first wing extending from the first end perpendicular to the longitudinal axis, and having a proximal end formed continuously with the blanket portion and a free distal end opposite the proximal end, an upper section, and a lower section, wherein the first wing is substantially rectangular and comprises a first corner having a concave curvature and forming an arc with a substantially constant radius of curvature in the upper section of the distal end and a second corner having a concave curvature and forming an arc with a substantially constant radius of curvature in the lower section of the distal end;

a second wing extending from the second end perpendicular to the longitudinal axis, and having a proximal end formed continuously with the blanket portion and a free distal end opposite the proximal end, an upper section, and a lower section, wherein the second wing is substantially rectangular and comprises a third corner having a concave curvature and forming an arc with a substantially constant radius of curvature in the upper section of the distal end and a fourth corner having a concave curvature and forming an arc with a substantially constant radius of curvature in the lower section of the distal end;

wherein the first wing comprises a hook material at its distal end and the second wing comprises a loop material at its distal end configured to mate with the hook material;

a pair of upper straps extending through the blanket portion, each upper strap comprising a free end and a fastener end having a buckle thereon, and a second pair of straps extending through the blanket portion, each lower strap comprising a free end and a fastener end having a buckle thereon;

placing the seat contact face of the blanket portion upon the seat structure;

wrapping the free ends of the upper straps over the backrest of the seat structure and engaging the free ends with the buckles of the fastener ends;

passing the free ends of the lower straps under the base of the seat structure and engaging the free ends with the buckles of the fastener ends; positioning a user upon the user contact face the blanket portion; and folding the first wing and the second wing over the user and stacking their distal ends so as to mate the hook material with the loop material.

* * * * *